US006119412A

United States Patent [19]

Jackson

[11] Patent Number: 6,119,412

[45] Date of Patent: Sep. 19, 2000

[54] PLYWOOD TRAILER PAD SYSTEM

[76] Inventor: Richard F. Jackson, 419 Meadow View Dr., Vacaville, Calif. 95688

[21] Appl. No.: 09/220,934

[22] Filed: Dec. 24, 1998

[51] Int. Cl.[7] ..... E04B 1/34

[52] U.S. Cl. ..... 52/143; 52/DIG. 11; 248/188.1

[58] Field of Search ..... 248/188.1, 205.3, 248/205.4, 125.8, 354.1; 52/143, DIG. 11, 735.1, 736.1

[56] References Cited

U.S. PATENT DOCUMENTS 3,830,024 8/1974 Warnke ..... 52/23
4,684,097 8/1987 Cox ..... 248/354.3
4,882,887 11/1989 Giles et al. ..... 52/126.6
4,895,335 1/1990 Oliver ..... 52/126.7
5,653,415 8/1997 Schworer ..... 248/354.1

*Primary Examiner*—Carl D. Friedman
*Assistant Examiner*—Christy M. Syres

[57] ABSTRACT

A plywood trailer pad system is provided for use with a trailer home including a plurality of trailer beams mounted thereunder and a plurality of trailer supports each mounted to one of the trailer beams and depending therefrom. Also included is a plurality of pads for being situated between a recipient surface and each trailer support of the trailer home. Each pad includes at least one piece of plywood with a planar configuration and a plurality of layers adhered with an adhesive and compacted with a predetermined force.

5 Claims, 5 Drawing Sheets

FIG. 3

| SINGLE | | |
|---|---|---|
| SIZE | PSF | SOIL BRG |
| 3/4"x 18"x24" | 1000 | 3000 |
| | 2000 | 6000 |
| | 3000 | 9000 |

FIG. 4

| SINGLE | | |
|---|---|---|
| SIZE | PSF | SOIL BRG |
| 3/4"x 16"x20" | 1000 | 2667 |
| | 2000 | 5333 |
| | 3000 | 8000 |

FIG. 5

| DOUBLE | | |
|---|---|---|
| SIZE | PSF | SOIL BRG |
| 5/8"x13"x26-5/8<br>3/4"x 13"x 26-5/8 | 1000 | 4808 |
| | 1250 | 6010 |
| | 1500 | 7211 |

FIG. 6

| DOUBLE | | |
|---|---|---|
| SIZE | PSF | SOIL BRG |
| 3/4" x 16" x 16"<br>3/4"x 24"x 24" | 1000 | 4000 |
| | 1250 | 5000 |
| | 1500 | 6000 |

PLYWOOD TRAILER PAD SYSTEM

BACKGROUND OF THE INVENTION

1. Field of the Invention

The present invention relates to concrete trailer pads and more particularly pertains to a new plywood trailer pad system for employing plywood in the construction of trailer pads for improved support of a trailer.

2. Description of the Prior Art

The use of concrete trailer pads is known in the prior art. More specifically, concrete trailer pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art concrete trailer pads include U.S. Pat. No. 4,684,097; U.S. Pat. No. 4,895,335; U.S. Pat. Des. No. 356,416; U.S. Pat. No. 5,419,524; U.S. Pat. No. 3,222,030; and U.S. Pat. No. 496,739.

In these respects, the plywood trailer pad system according to the present invention substantially departs from the conventional concepts and designs of the prior art, and in so doing provides an apparatus primarily developed for the purpose of employing plywood in the construction of trailer pads for improved support of a trailer.

SUMMARY OF THE INVENTION

In view of the foregoing disadvantages inherent in the known types of employing plywood in the construction of trailer pads for improved support of a trailer now present in the prior art, the present invention provides a new plywood trailer pad system construction wherein the same can be utilized for employing plywood in the construction of trailer pads for improved support of a trailer.

The general purpose of the present invention, which will be described subsequently in greater detail, is to provide a new plywood trailer pad system apparatus and method which has many of the advantages of the concrete trailer pads mentioned heretofore and many novel features that result in a new plywood trailer pad system which is not anticipated, rendered obvious, suggested, or even implied by any of the prior art concrete trailer pads, either alone or in any combination thereof.

To attain this, the present invention is adapted for use with a trailer home having a plurality of trailer beams mounted thereunder. A plurality of trailer jacks each include an upper extent mounted to one of the trailer beams and depending therefrom. Associated therewith is a lower extent with an upper end slidably received by the upper extent. A lower end of the lower extent is equipped with a generally planar square foot mounted thereon for supporting the trailer home. It should be noted that a relative orientation of the upper extent and the lower extent of each trailer jack may be adjusted to change an elevation of the trailer home. The present invention includes a plurality of pads for being situated between a recipient surface and the foot of each trailer jack of the trailer home. Each pad includes a first piece of plywood with a planar square configuration. As is common with plywood, the same has a plurality of layers adhered with an adhesive and compacted with a predetermined force. Further, the first piece of plywood has a first surface area. Each pad further includes a second piece of plywood with a planar square configuration. Similar to the first piece of plywood, the second piece has a plurality of layers adhered with an adhesive and compacted with a predetermined force. The second piece of plywood, however, has a second surface area which is less than the first surface area. As shown in FIG. 1, the second piece of plywood is centrally positioned on top of the first piece of plywood such that side edges of the second piece of plywood remain in parallel relationship with those of the first piece of plywood. Next provided is a plurality of countersunk bores formed in the second piece of plywood for receiving flathead screws therein. Such screws secure the second piece of plywood onto the first piece of plywood. In the preferred embodiment, the countersunk bores are formed at each corner of the second piece of plywood and further at a midpoint of each side edge thereof. In addition, at least four countersunk bores are further formed at a central extent of the second piece of plywood. In use, the pads are centrally positioned below the foot of the associated trailer jack such that side edges of the pieces of plywood remain in parallel relationship with those of the foot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plywood trailer pad system apparatus and method which has many of the advantages of the concrete trailer pads mentioned heretofore and many novel features that result in a new plywood trailer pad system which is not anticipated, rendered obvious, suggested, or even implied by any of the prior art concrete trailer pads, either alone or in any combination thereof.

It is another object of the present invention to provide a new plywood trailer pad system which may be easily and efficiently manufactured and marketed.

It is a further object of the present invention to provide a new plywood trailer pad system which is of a durable and reliable construction.

An even further object of the present invention is to provide a new plywood trailer pad system which is susceptible of a low cost of manufacture with regard to both materials and labor, and which accordingly is then susceptible of low prices of sale to the consuming public, thereby making such plywood trailer pad system economically available to the buying public.

Still yet another object of the present invention is to provide a new plywood trailer pad system which provides in the apparatuses and methods of the prior art some of the advantages thereof, while simultaneously overcoming some of the disadvantages normally associated therewith.

Still another object of the present invention is to provide a new plywood trailer pad system for employing plywood in the construction of trailer pads for improved support of a trailer.

Even still another object of the present invention is to provide a new plywood trailer pad system for use with a trailer home including a plurality of trailer beams mounted thereunder and a plurality of trailer supports each mounted to one of the trailer beams and depending therefrom. Also included is a plurality of pads for being situated between a recipient surface and each trailer support of the trailer home. Each pad includes at least one piece of plywood with a planar configuration and a plurality of layers adhered with an adhesive and compacted with a predetermined force.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a chart setting forth what the retention amount (in pounds per square foot) of plywood of a first size should be when constructed based on a type of soil on which the pads are to be employed.

FIG. 4 is a chart setting forth what the retention amount of plywood of a second size should be when constructed based on a type of soil on which the pads will be employed.

FIG. 5 is a chart setting forth what the retention amount of two pieces of plywood should be when constructed based on a type of soil on which the pads will be employed.

FIG. 6 is a chart setting forth what the retention amount of another two pieces of plywood should be when constructed based on a type of soil on which the pads will be employed.

DESCRIPTION OF THE PREFERRED EMBODIMENT

Figure 1:
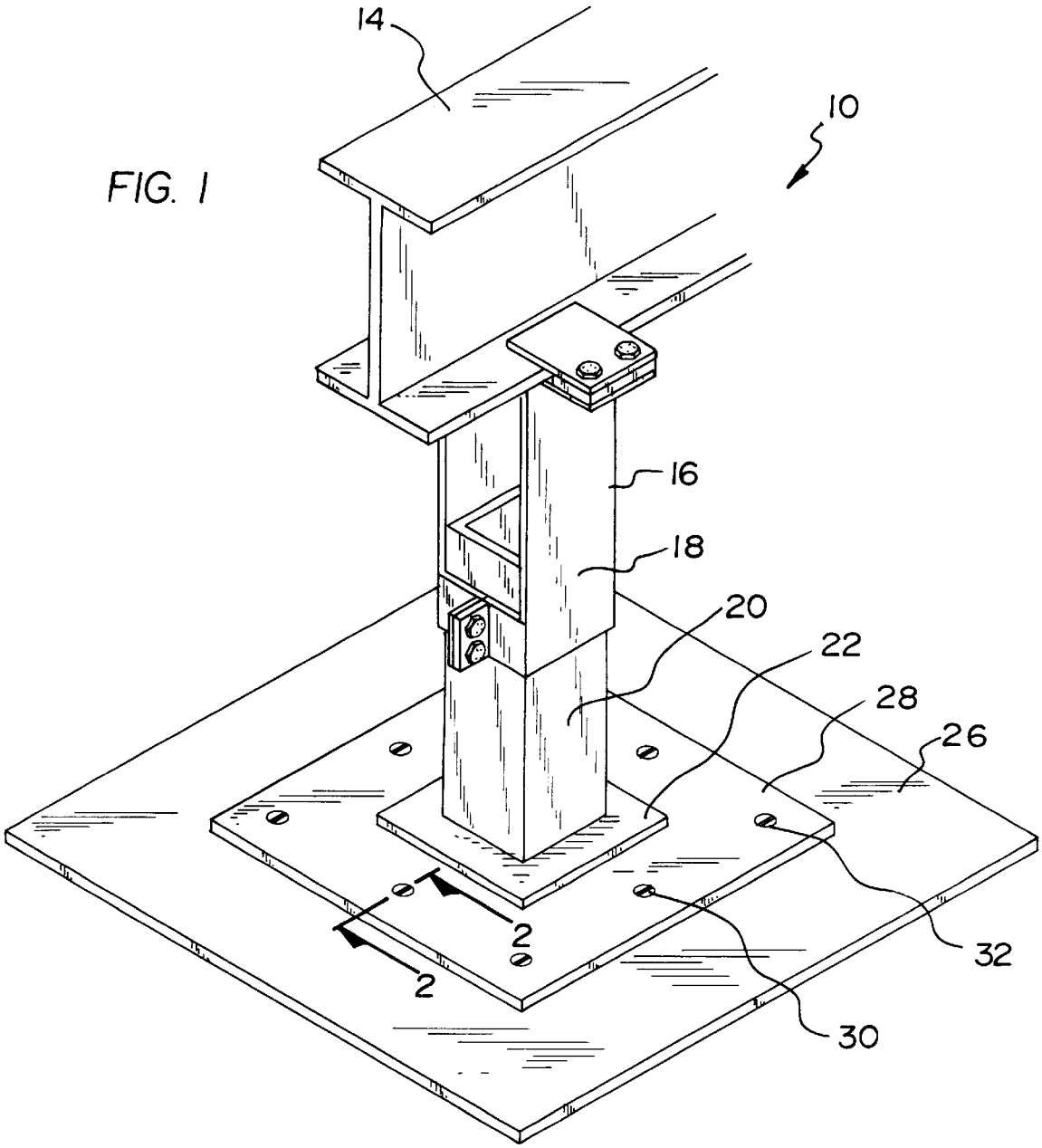
FIG. 1 is a perspective view of a new plywood trailer pad system according to the present invention.
Figure 2:
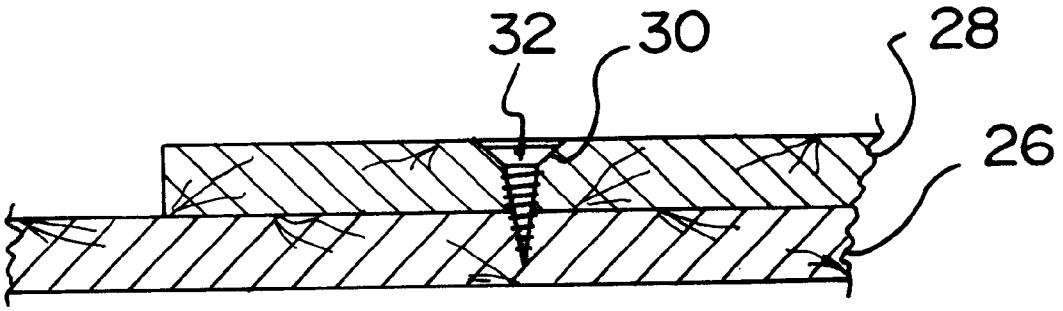
FIG. 2 is a side cross-sectional view of one of the pads of the present invention.
Figure 7:
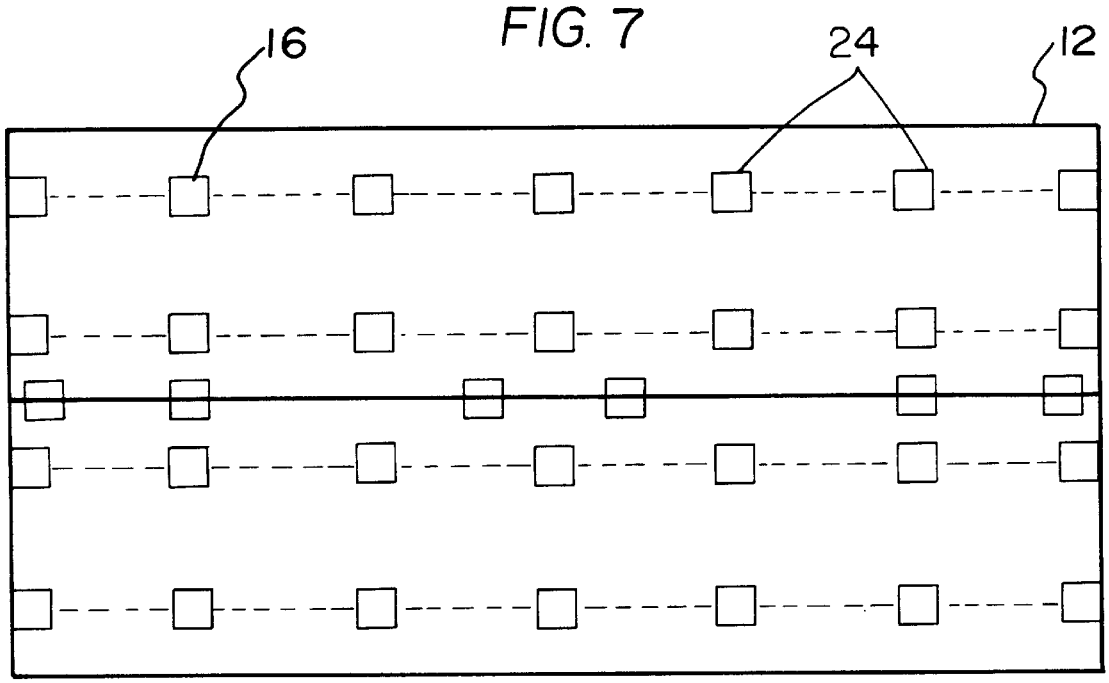
FIG. 7 is a layout of the pads and trailer jacks of a conventional trailer home.

With reference now to the drawings, and in particular to FIGS. 1 through 7 thereof, a new plywood trailer pad system embodying the principles and concepts of the present invention and generally designated by the reference numeral 10 will be described.

The present invention, designated as numeral 10, is adapted for use with a trailer home 12 having a plurality of trailer beams 14 mounted thereunder. A plurality of trailer jacks 16 each include an upper extent 18 mounted on one of the trailer beams and depending therefrom. Associated therewith is a lower extent 20 with an upper end slidably received by the upper extent. A lower end of the lower extent is equipped with a generally planar square foot 22 mounted thereon for supporting the trailer home. It should be noted that a relative orientation of the upper extent and the lower extent of each trailer jack may be adjusted to change an elevation of the trailer home.

The present invention includes a plurality of pads 24 for being situated between a recipient surface and the foot of each trailer jack of the trailer home. Each pad includes a first piece of plywood 26 with a planar square configuration. As is common with plywood, such piece of plywood has a plurality of layers adhered with an adhesive and compacted with a predetermined force. Further, the first piece of plywood has a first surface area.

Each pad further includes a second piece of plywood 28 with a planar square configuration. Similar to the first piece of plywood, the second piece has a plurality of layers adhered with an adhesive and compacted with a predetermined force. The second piece of plywood, however, has a second surface area which is less than the first surface area. As shown in FIG. 1, the second piece of plywood is centrally positioned on top of the first piece of plywood such that side edges of the second piece of plywood remain in parallel relationship with those of the first piece of plywood. It should be understood that the specific use of a pair of stacked pieces of plywood is critical for affording an equal or less amount of deflection of a single pad of greater thickness. This is important in that cost savings result with such design. As an option, however, a single piece of plywood may be employed if desired. Further, it should be noted that the first piece of plywood may take the form of a pair of pieces maintained in coplanar relationship.

Next provided is a plurality of countersunk bores 30 formed in the second piece of plywood for receiving ⅜ by 1½ inch lag screws 32 therein. Ideally, each screw is fitted with a washer. Such screws secure the second piece of plywood onto the first piece of plywood. In the preferred embodiment, the countersunk bores are formed at each corner of the second piece of plywood and further at a midpoint of each side edge thereof. In addition, at least four countersunk bores are further formed at a central extent of the second piece of plywood. It should be noted that the foregoing configuration of bores and screws is critical for not only affording ideal deflection, but also aiding in complying with special earthquake performance standards.

The specific retention of each piece of plywood is selected as a function of soil brg. Note FIGS. 3–6. Interpolation may be employed to accommodate soil brg that is not listed. It should be noted that in an alternate embodiment, only a single piece of plywood may be employed. The specific retention amounts for such embodiment are shown in FIGS. 3 & 4.

Moreover, the specific relative thickness and surface areas of the two pieces of plywood are selected as a function of the amount of vertical and horizontal stress to which the pad is to be subjected. Such selection is made in order to make optimum use of the plywood, deliver the best deflection results and further to require the fewest number of piers per trailer. Possible combinations could include a ⅝ or ¾ inch thick by 13 by 21⅜ inch upper pad over a pair of ¾ by 13 by 21⅜ inch lower pads, a ⅝ or ¾ inch thick by 13 by 26⅝ inch upper pad over a pair of ¾ by 13 by 26⅝ inch lower pads, a ⅝ or ¾ inch thick by 17⅕ by 19⅕ inch upper pad over a pair of ¾ by 17½ by 19⅕ inch lower pads, a ¾ by 16 by 16 inch upper pad over a single ¾ by 24 by 24 inch lower pad, a ⅝ or ¾ inch thick by 13 by 19.2 inch upper pad over a ¾ by 24 by 24 inch lower pad, and a ⅝ or ¾ inch thick by 13 by 19⅕ inch upper pad over a pair of ¾ by 13 by 19¹¹⁄₅ inch lower pads.

In use, the pads are centrally positioned below the foot of the associated trailer jack such that side edges of the pieces of plywood remain in parallel relationship with those of the foot.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plywood trailer pad system comprising, in combination:

a trailer home including a plurality of trailer beams mounted thereunder and a plurality of trailer jacks each including an upper extent mounted to one of the trailer beams and depending therefrom and a lower extent with an upper end slidably received by the upper extent and a lower end with a generally planar square foot mounted thereon for supporting the trailer home, wherein a relative orientation of the upper extent and the lower extent of each trailer jack may be adjusted to change an elevation of the trailer home;

a plurality of pads for being situated between a recipient surface and the foot of each trailer jack of the trailer home, each pad including:

a first piece of plywood with a planar square configuration and having a plurality of layers adhered with an adhesive and compacted with a predetermined force, the first piece of plywood having a first surface area, a second piece of plywood with a planar square configuration and having a plurality of layers adhered with an adhesive and compacted with a predetermined force, the second piece of plywood having a second surface area being less than the first surface area, the second piece of plywood being centrally positioned on top of the first piece of plywood such that side edges of the second piece of plywood remain in parallel relationship with those of the first piece of plywood, and a plurality of countersunk bores formed in the second piece of plywood for receiving flathead screws therein to secure the second piece of plywood onto the first piece of plywood, the countersunk bores formed at each corner of the second piece of plywood and further at a midpoint of each side edge thereof, wherein at least four countersunk bores are further formed at a central extent of the second piece of plywood;

wherein pads are centrally positioned below the foot of the associated trailer jack such that side edges of the pieces of plywood remain in parallel relationship with those of the foot.

2. A plywood trailer pad system comprising:

a trailer home including a plurality of trailer beams mounted thereunder and a plurality of trailer supports each mounted to one of the trailer beams and depending therefrom;

a plurality of pads for being situated between a recipient surface and each trailer support of the trailer home, each pad including at least one piece of plywood with a planar configuration and a plurality of layers adhered with an adhesive and compacted with a predetermined force.

3. A plywood trailer pad system as set forth in claim 2 wherein two pieces of plywood are included.

4. A plywood trailer pad system as set forth in claim 3 wherein a first piece of plywood has a first surface area and a second piece of plywood has a second surface area being less than the first surface area, the second piece of plywood being centrally positioned on top of the first piece of plywood.

5. A plywood trailer pad system as set forth in claim 3 wherein a plurality of bores are formed in the second piece of plywood for receiving screws therein to secure the second piece of plywood onto the first piece of plywood, the bores being formed at each corner of the second piece of plywood and further at a midpoint of each side edge thereof, wherein at least four countersunk bores are further formed at a central extent of the second piece of plywood.

* * * * *